US005409340A

United States Patent [19]

Engert

[11] Patent Number: 5,409,340

[45] Date of Patent: Apr. 25, 1995

[54] SPINE STRIP FORMATION AND FEED METHOD AND APPARATUS

[75] Inventor: Holger Engert, Rahden, Germany

[73] Assignee: Kolbus GmbH & Co. KG, Rahden, Germany

[21] Appl. No.: 267,819

[22] Filed: Jun. 28, 1994

[30] Foreign Application Priority Data

Jul. 1, 1993 [DE] Germany ..... 43 21 890.3

[51] Int. Cl.[6] ..... B42C 11/02

[52] U.S. Cl. ..... 412/11; 412/13; 412/19; 281/29

[58] Field of Search ..... 281/21.1, 29, 31; 412/19, 34, 900, 11, 13

[56] References Cited

U.S. PATENT DOCUMENTS 3,911,517 10/1975 Davis ..... 412/900

FOREIGN PATENT DOCUMENTS

3614167A1 10/1987 Germany .
3702391A1 8/1988 Germany .
2164323 3/1986 United Kingdom .

*Primary Examiner*—Paul A. Bell
*Attorney, Agent, or Firm*—Chilton, Alix & Van Kirk

[57] ABSTRACT

Spine strip stock material, being withdrawn from a supply reel, is cut into pieces of the desired length and the pieces are subsequently fed into positionally accurate contact with cover boards which are moving on a conveying system. High cutting and feeding accuracy are achieved by a servomotor control system which, in response to sensing the motion of the cover boards, stops the infeed of the stock material, clamps and cuts the stationary stock material, feeds the cut spine strip pieces to a waiting position and then moves the pieces from the waiting position into contact with the cover boards.

12 Claims, 3 Drawing Sheets

SPINE STRIP FORMATION AND FEED METHOD AND APPARATUS

BACKGROUND OF THE INVENTION

1. Field of the Invention

The present invention relates to the formation, from strip-like stock, of spine strips and to the subsequent registration of the formed strips with cover boards in the course of manufacture of book covers. More particularly, this invention is directed to apparatus which produces, from material being drawn from a supply reel, book cover spine strips of predetermined length and thereafter accurately positions the thus produced spine strips on moving cover boards. Accordingly, the general objects of the general invention are to provide novel and improved apparatus and methods of such character.

2. Description of the Prior Art

In the manufacture of books, covers are formed by applying a spine or center strip to a cover board. The material from which the spine strips are formed is customarily supplied to the book cover production machinery as continuous stock having the appropriate width which is stored on a supply reel. In the prior art book cover production machines, this stock was cut to length by means of apparatus which operated either intermittently or continuously.

In the prior art intermittently operated cutters, the spine strip stock was pulled from the supply reel by means of a transport which included a link-type drive system. The drive system was adjustable so that the spine strip could be cut to the length currently specified. In such pull-off arrangements, tension forces act directly on the supply reel and, during each cutting step, the supply reel is brought to a complete stop. The supply reel will inherently have a significant moment of inertia, and this inertia must be overcome each time the forward feed of the stock is resumed. The tension forces on the supply reel will change as the effective diameter of the reel changes, due to the withdrawal of material therefrom, and the inertia to be overcome for each withdrawal sequence will also change with the change in diameter. The varying tension forces lead to slip and thus to inaccuracies in the cut piece length. Moreover, if the center strip material is narrow and thin, and if this material is furnished on a large diameter supply reel, there is a very significant risk of the strip material breaking as a result of the effort to overcome the moment of inertia.

The spine strip pull-off devices of the type briefly discussed above, which employ link-type drive systems with interposed free wheel mechanisms, are also characterized by a severely limited production rate. Restated, it is difficult to increase the operational speed of these intermittently operated devices because the rate of movement of the strip material is constantly changing.

In the case of proposed devices which advance the spine strip stock material continuously, it has been suggested that the pull-off apparatus include a suction wheel and that the cutting-to-length be accomplished by means of a cross-cutting device consisting of a pair of rotary driven, angled knives. Obviously, for such apparatus to function properly, the rotating cross-cutting knives must be precisely and continuously synchronized with respect to both the advancement speed of the strip material and the currently specified spine strip length. The achievement of such synchronization demands complex and thus expensive apparatus. Furthermore, even if the requisite sychronization could be achieved, there is nevertheless an inherent possibility that length inaccuracy will occur due, by way of example only, to the transporting action of the suction wheel being affected by slip. Additionally, there is a further inherent risk that the moving spine strip material will not be severed precisely at a right-angle to its side edges.

As a further disadvantage of the proposed continuously operating pull-off arrangements for spine strip formation apparatus, the resetting of such devices for different strip lengths entails substantial expense, particularly because such resetting requires skilled and well trained personnel.

Published German Patent Application 36 14 167 discloses apparatus for the manufacture of book covers wherein spine strip stock material is pulled from a supply reel, cut to length by a cross-knife type cutting device, and then supplied to the "cloth cylinder" associated with the book cover machine. In order to achieve the requisite cut length accuracy, in the apparatus of the published application the cutting operation is performed between two transport steps. Thus, a cut length mechanism is provided for driving a system of transport rollers which are installed upstream of the cutting station, the range of constant rotary movement of these transport rollers being adjustable to correspond to the desired cut length. The range of movement is controlled through the use of cams which are installed such that they can be twisted relative to one another.

In the apparatus of German Application 36 14 167, the delivery of the cut-to-length spine strip to the cloth cylinder is accomplished by feeding the strip along a channel under the influence of spaced pairs of rollers which are rotated by a center strip transport mechanism. This center strip transport mechanism is connected to the cut length mechanism through a multiplicity of drive elements. This type of interconnected drive, employing mechanical components to couple two movement sequences, will inherently be deleteriously affected by tolerance errors resulting from inaccuracies in manufacture. At high throughput rates, such errors are particularly detrimental to the cut length accuracy and to the accuracy achieved in the operation in which the spine strip and cover boards are brought together at the cloth cylinder.

SUMMARY OF THE INVENTION

The present invention overcomes the above-briefly discussed and other deficiencies and disadvantages of the prior art, and in so doing, provides a method of and apparatus for forming book covers at a high production rate with high reliability and extremely high cut length accuracy. The present invention additionally achieves highly accurate mating of the spine strips with the cover boards. In accordance with the invention, the spine strip material is pulled from a supply reel or the like and positioned at a cutting station, and the cut-to-length spine strip is thereafter controllably conveyed through a transport channel and into positionally accurate registration with a cover board.

Apparatus in accordance with the preferred embodiment of the invention comprises a control system which employs a servomotor. This servomotor provides the drive for a pair of cut length transport rollers which pull the spine strip material from storage and feed it into the cutting station. This same servomotor provides the drive for pairs of infeed rollers which convey the cut-to-length spine strip to the cloth cylinder of the book cover machine. The control system provides a timed movement sequence and includes means which cause the cut length transport rollers to effectively be disengaged after a preselected length of spine strip has been fed past the cutting device. The means for causing the cut-length transport rollers to be selectively ineffective to drive the spine strip stock material operates in conjunction with a clamping device which holds the spine strip material during the actual cutting operation. The control system of the present invention also positions the cut-to-length spine in a waiting position in the transport channel, downstream of the cutting station, and releases the cut-to-length spine strip in synchronism with the movement of cover boards that are supplied according to a timed movement sequence.

BRIEF DESCRIPTION OF THE DRAWING

The present invention may be better understood, and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 1:
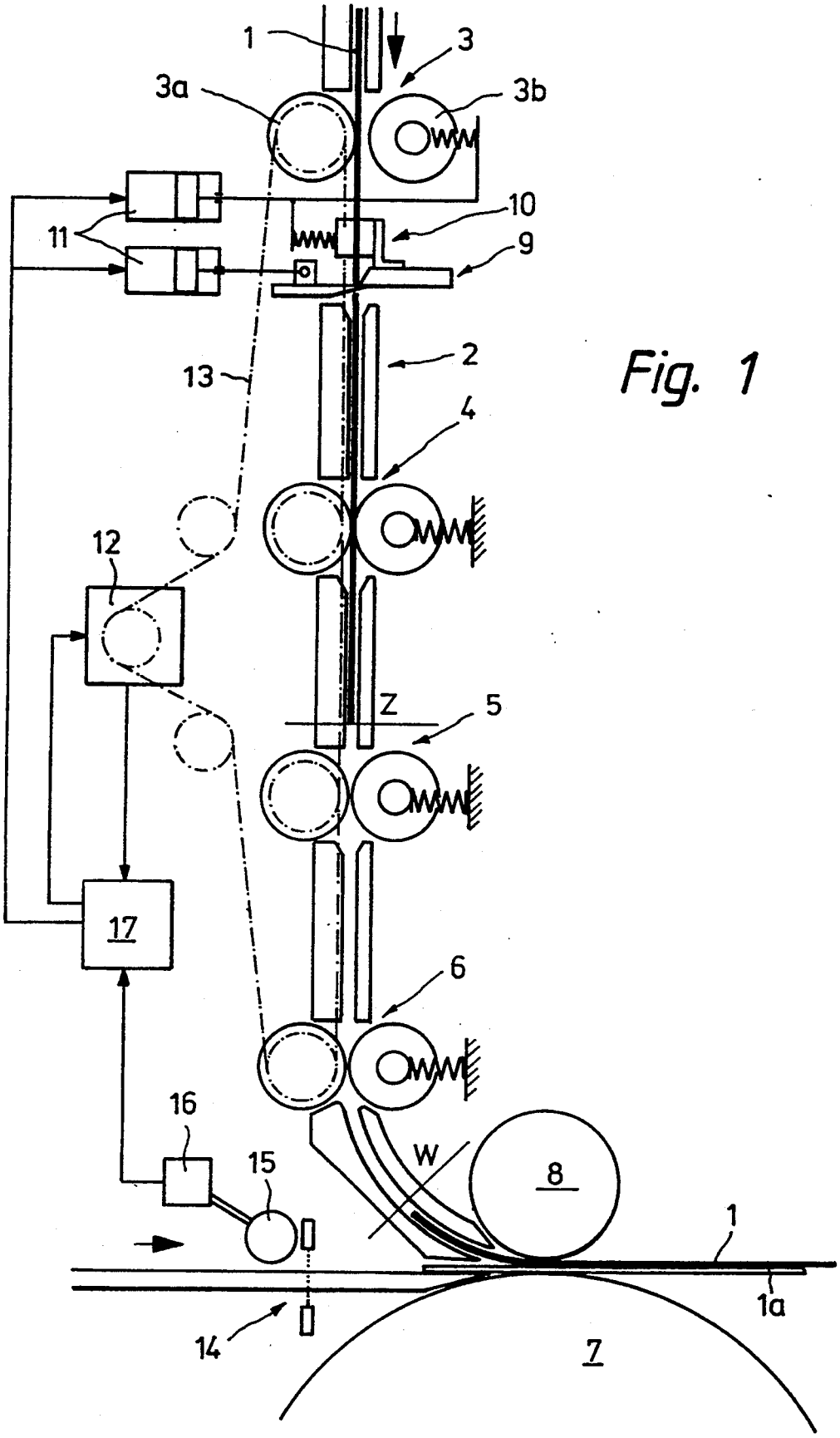
FIG. 1 is a schematic illustration of apparatus in accordance with a first embodiment of the invention, FIG. 1 showing the apparatus in a first phase of its operating sequence.

With reference now to the drawings, spine or center strip stock material, which is being withdrawn from a supply reel or the like, is indicated at 1. The strip material 1 is fed to to a conveying system defined by a transport channel, indicated generally at 2, and a series of spaced-apart pairs of transport rollers which have been indicated generally at 3, 4, 5 and 6. The conveying system moves the strip material 1 from its source, not shown, through a cutting station and, ultimately, to a cloth cylinder 7. At the cloth cylinder 7, the cut-to-length individual spine strips, i.e. the pieces cut from the infed raw strip material, are accurately positioned on book cover boards 1*a*.

The transport rollers 3, which comprise individual driven roll 3*a* and a cooperating idler roll 3*b*, form the cut length transport which pulls the strip material 1 into the conveying system and pushes the strip material past the downstream cutting station and into the transport channel 2. The cutting station is defined by the actual cutting mechanism 9, which includes a movable knife and stationary anvil, and a clamping device 10. As may be seen from the drawings, the clamping device 10 is positioned upstream of the cutting mechanism 9 and between the cutting mechanism and the cut-length transport rollers 3*a* and 3*b*. The cutting device 9 and the clamping device 10 are operated by pneumatic actuators 11.

The cut-length transport rollers 3 and the pairs of downstream infeed transport rollers 4, 5 and 6 are driven by a common servomotor 12, the drive being via a chain 13 which couples the driven roller of each roller pair to motor 12. The opposed or idler roller of each pair is thus driven by frictional coupling to the chain-driven roller. The operation of motor 12, in the manner to be described below, is controlled by means of a controller 17. Controller 17 receives, in the conventional manner, a feedback signal from motor 12 and control signals from a cover board sensor 14, 15, 16.

In the operation of the present invention, when motor 12 is energized by controller 17, both rollers of each of the pairs of infeed rollers 4, 5 and 6 are driven, i.e., any cut-to-length spine strip passing between these rollers will be advanced along the conveying system. However, while roller 3*a* of the cut length roller pair 3 is commonly driven with the infeed rollers, because of transverse movement imparted to idler roller 3*b*, the cut-length rollers act on, i.e., drive, the spine strip material 1 intermittently. The transverse movement of roller 3*b* is derived from the same pneumatic actuator which controls operation of clamp 10. Thus, as may be seen by comparing FIGS. 1 and 2 with FIG. 3, clamp 10 is opened when a driving connection between the strip material 1 and cut-length rollers 3 is established. Conversely, the incoming strip 1 is clamped and cut when the roller 3*b* is retracted and the feeding in of the strip material interrupted. The outward movement of roller 3*b*, in order to interrupt the infeeding of the spine strip material, is commanded when a defined pull-off length has been reached as determined by a position measuring system such as a resolver or an incremental transmitter coupled to servomotor 12.

Synchronous movement of the cut-to-length spine strip relative to the incoming cover board, in order to bring the two elements together with positional accuracy, is accomplished through the operation of the controller 17. In exercising this control, the movement of the cover board la functions as the master, i.e., the position and speed of the incoming cover board is the input information upon which the remainder of the apparatus acts. The movement of cover board 1*a* is sensed by a contact roller 15. The rotation of roller 15, in turn, is sensed by a incremental transmitter 16 and a signal commensurate therewith is delivered to the controller 17. Controller 17 thereafter controls the speed of motor 12 and the operation of actuators 11 in order to, in the proper sequence, cut the material 1 to produce a piece of specified length and to feed the thus cut spine strip into the nip of cloth cylinder 7 and cooperating pressure roller 8 in such a manner that it is accurately positioned on top of an in-coming cover board 1*a*.

As the apparatus is depicted in FIG. 1, the cut length roller 3*b* has been retracted, the clamp 10 is closed and the cutter 9 has been operated to sever a spine strip of the correct length from the continuous strip being withdrawn from the source. The cut-to-length spine strip is positioned with its leading edge at point "Z". Also, at this time, the previously cut spine strip, along with a cover board la, is being drawn between cloth cylinder 7 and cooperating pressure roller 8.

Figure 2:
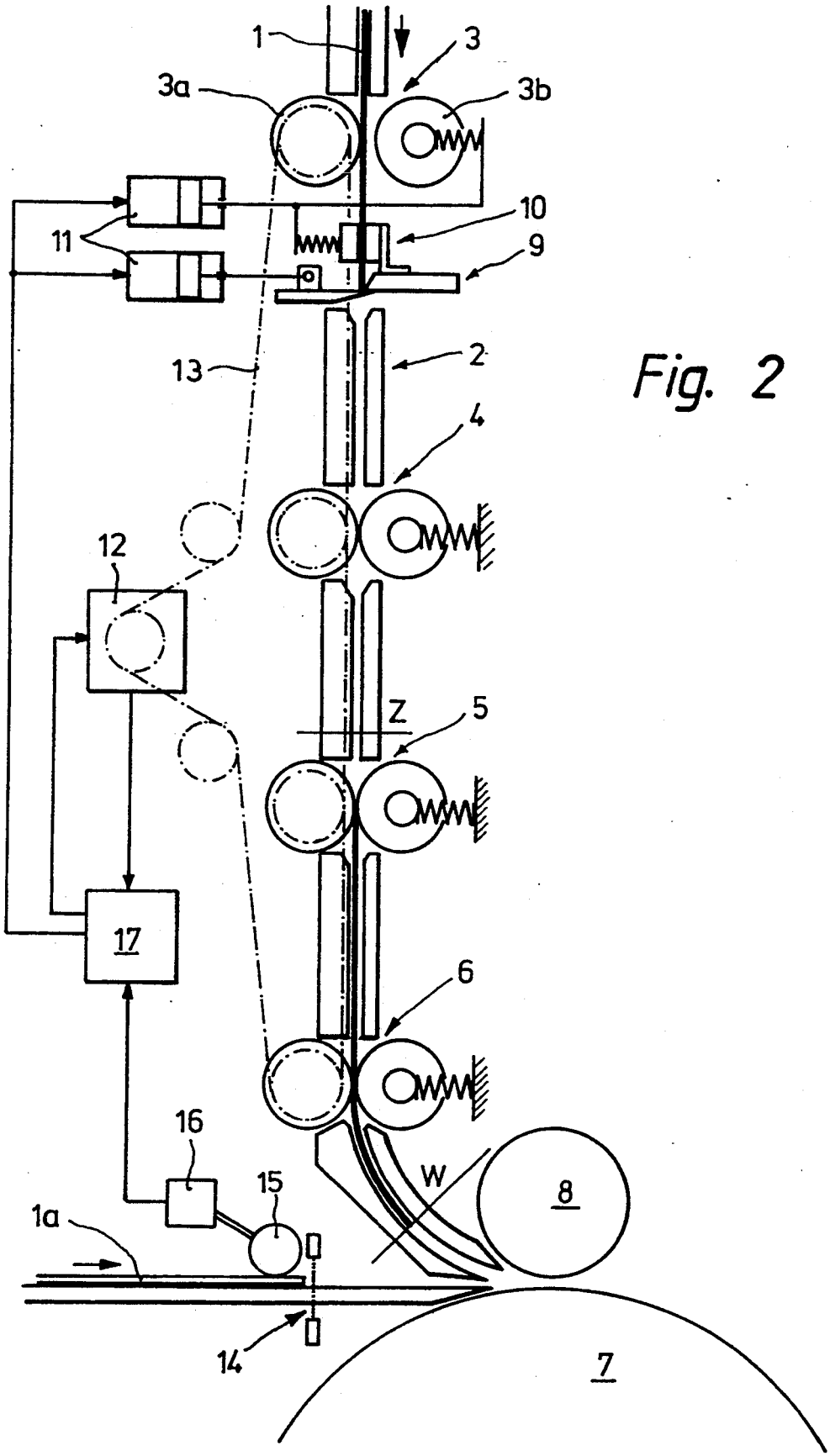
FIG. 2 is a view similar to FIG. 1 depicting the apparatus in a second phase of its operating sequence.

As shown in FIG. 2, the servomotor drive has operated to advance the cut-to-length spine strip such that its leading edge is at a waiting position "W", i.e., the cut-to-length spine piece has been moved downstream in the conveying direction from point "Z" to point "W". At this time, the cut-length roller 3*b* remains retracted and the clamp 10 remains closed. Accordingly, the driving of the infeed rollers 4–6 by servomotor 12 does not produce any movement of the uncut ribbon of spine material 1 located upstream of the cutting device 9. At this time, i.e., with the cut-to-length spine strip at waiting position "W", an incoming cover board 1*a* has been acquired by the contact roller 15 of the cover board sensor 15.

Figure 3:
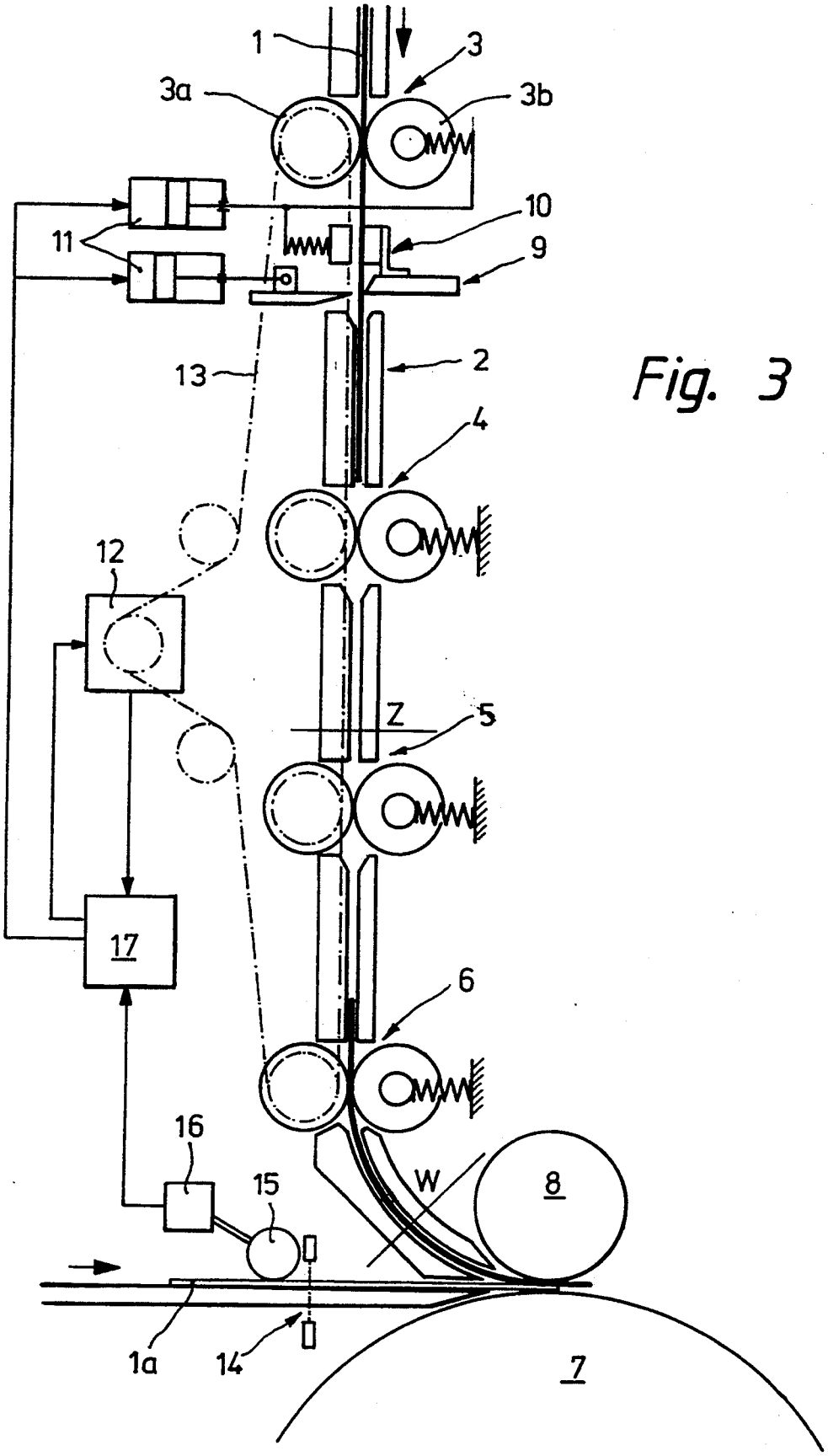
FIG. 3 is a view similar to FIGS. 1 and 2 depicting the apparatus in a third phase of its operating sequence.

As depicted in FIG. 3, when the leading edge of the incoming cover board 1*a* interrupts the light path of photodetector 14 of the cover board sensor, and in response to the rate of movement of cover board 1*a*, the servomotor 12 will be actuated by controller 17 and will cause transport of the cut-to-length spine strip, at the speed of the cover board, from waiting position "W" through a guide channel and into contact with the advancing board 1*a*, the point of contact coinciding with the nip of roller 8 and cloth cylinder 7. The cover board 1*a* and the spine strip will thus be accurately positioned relative to one another and will be advanced at the same speed. The pneumatic actuators 11, in response to signals from controller 17 when the spine strip is caused to move from waiting position "W", will cause clamp 10 to be opened, the movable blade of the cutting device 9 to be retracted and the roller 3*b* of the cut length transport rollers to be moved back into engagement with the incoming spine strip material 1. The spine strip material 1 will then be fed through channel 2 and between infeed rollers 4 until its leading edge reaches the desired cut length position Z.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for forming, from strip-like stock material, spine strips and registering the thus formed spine strips with book cover boards, said apparatus comprising:

selectively operable cutting means for severing the strip-like stock material;

cut length transport means for selectively engaging the strip-like stock material and pulling the thus engaged stock material from a source and feeding a preselected length of the stock material though said cutting means whereby operation of said cutting means will sever a spine strip of preselected length from the stock material;

infeed transport means positioned downstream, in the direction of spine strip movement, from said cutting means for conveying the cut-to-length spine strip into registration with a book cover board, said infeed transport means including a series of pairs of infeed rollers and a transport channel;

servomotor means for driving said cut length transport means and said infeed transport means rollers;

actuator means for causing said cut length transport means to selectively engage and disengage from the strip-like stock material;

controller means for causing operation in proper sequence, of said cutting means and said actuator means, said controller means further controlling the energization and speed of said servomotor means whereby the stock material may be fed through said cutting means, said cut length transport means disengaged from the stock material, said stock material cut to the desired spine strip length, the cut-to-length spine strip moved to a feed position immediately upstream of the point where it is brought into contact with a book cover board, the cut-to-length spine strip subsequently fed into registration with a book cover board and the cut length transport means caused to re-engage the stock material to feed a further length thereof through said cutting means.

2. The apparatus of claim 1 wherein said cut length transport means comprises a further pair of rollers, the stock material passing between said further rollers, a first of said further rollers being directly driven by said servomotor means, the second of said further rollers being driven by friction with said directly driven roller, said actuator means causing said second roller to move toward or away from said driven roller.

3. The apparatus of claim 1 wherein said actuator means also causes operation of said cutting means.

4. The apparatus of claim 1 wherein said infeed transport means defines a wait position for a cut-to-length spine strip, the strip being clamped between a pair of said infeed rollers when in the wait position.

5. The apparatus of claim 1 further comprising:

means for sensing the movement of in-coming book cover boards and generating control signals commensurate therewith, said control signals being delivered to said controller means whereby the operation of said servomotor means is controlled as a function of the movement of the incoming cover boards.

6. The apparatus of claim 5 wherein said cut length transport means comprises a further pair of rollers, the stock material passing between said further rollers, a first of said further rollers of being directly driven by said servomotor means, the second of said further rollers being driven by friction with said directly driven roller, said actuator means causing said second roller to move toward or away from said driven roller.

7. The apparatus of claim 1 wherein said cutting means further comprises:

selectively operable clamp means, said clamp means being operated by said actuator means.

8. The apparatus of claim 7 further comprising:

means for sensing the movement of in-coming book cover boards and generating control signals commensurate therewith, said control signals being delivered to said controller means whereby the operation of said servomotor means is controlled as a function of the movement of the incoming cover boards.

9. The apparatus of claim 8 wherein said cut length transport means comprises a further pair of rollers, the stock material passing between said further rollers, a first of said further rollers of being directly driven by said servomotor means, the second of said further rollers being driven by friction with said directly driven roller, said actuator means causing said second roller to move toward or away from said driven roller.

10. The apparatus of claim 9 wherein said actuator means also causes operation of said cutting means.

11. The apparatus of claim 9 wherein said infeed transport means defines a wait position for a cut-to-length spine strip, the strip being clamped between a pair of said infeed rollers when in the wait position.

12. The apparatus of claim 2 wherein said cut length transport means comprises a further pair of rollers, the stock material passing between said further rollers, a first of said further rollers of being directly driven by said servomotor means, the second of said further rollers being driven by friction with said directly driven roller, said actuator means causing said second roller to move toward or away from said driven roller.

* * * * *